US010861625B2

(12) United States Patent
Lee et al.

(10) Patent No.: US 10,861,625 B2
(45) Date of Patent: Dec. 8, 2020

(54) ELECTRONIC COMPONENT AND MANUFACTURING METHOD THEREOF

(71) Applicant: SAMSUNG ELECTRO-MECHANICS CO., LTD., Suwon-si (KR)

(72) Inventors: Jong Pil Lee, Suwon-si (KR); Ichiro Tanaka, Suwon-si (KR); Doo Ho Yoo, Suwon-si (KR); Hyun Jun Choi, Suwon-si (KR); Hyung Gon Kim, Suwon-si (KR); Hyung Seok Roh, Suwon-si (KR); Jung Il Kim, Suwon-si (KR)

(73) Assignee: SAMSUNG ELECTRO-MECHANICS CO LTD, Suwon-si (KR)

( * ) Notice: Subject to any disclaimer, the term of this patent is extended or adjusted under 35 U.S.C. 154(b) by 0 days.

(21) Appl. No.: 16/299,721

(22) Filed: Mar. 12, 2019

(65) Prior Publication Data

US 2020/0090842 A1 Mar. 19, 2020

(30) Foreign Application Priority Data

Sep. 17, 2018 (KR) ..... 10-2018-0110896

(51) Int. Cl.
*H01C 7/00* (2006.01)
*H01C 17/12* (2006.01)
(Continued)

(52) U.S. Cl.
CPC ..... *H01C 7/006* (2013.01); *H01C 17/006* (2013.01); *H01C 17/12* (2013.01); *H01C 17/288* (2013.01)

(58) Field of Classification Search
CPC ..... H01C 7/006; H01C 17/006; H01C 17/12; H01C 17/288
(Continued)

(56) References Cited

U.S. PATENT DOCUMENTS 6,144,287 A * 11/2000 Komeda ..... H01C 7/00 29/620
2001/0026211 A1* 10/2001 Shindoh ..... H05K 1/167 338/308
(Continued)

FOREIGN PATENT DOCUMENTS

JP H10-321402 A 12/1998
JP 2001-345205 A 12/2001
(Continued)

OTHER PUBLICATIONS

Office Action issued in corresponding Korean Patent Application No. 10-2018-0110896, dated Oct. 22, 2019.
(Continued)

*Primary Examiner* — Nguyen Tran
*Assistant Examiner* — Iman Malakooti
(74) *Attorney, Agent, or Firm* — Morgan, Lewis & Bockius LLP

(57) ABSTRACT

An electronic component and a manufacturing method thereof are disclosed. An electronic component includes a substrate, a conductor pattern portion disposed on the substrate, a first electrode pattern and a second electrode pattern disposed on the conductor pattern portion, and at least one dummy electrode pattern disposed to be spaced apart from the first electrode pattern and the second electrode pattern and disposed on the substrate. A width of the first electrode pattern is substantially the same as a width of a portion of the conductor pattern portion in contact with the first electrode pattern, and a width of the second electrode pattern is
(Continued)

substantially the same as a width of a portion of the conductor pattern portion in contact with the second electrode pattern.

24 Claims, 15 Drawing Sheets

(51) Int. Cl.
*H01C 17/28* (2006.01)
*H01C 17/00* (2006.01)

(58) Field of Classification Search
USPC ..... 338/308
See application file for complete search history.

(56) References Cited

U.S. PATENT DOCUMENTS

| | | | | |
|---|---|---|---|---|
| 2002/0031860 | A1* | 3/2002 | Tanimura | H01C 17/006 438/108 |
| 2008/0290460 | A1 | 11/2008 | Iseki et al. | |
| 2013/0241361 | A1* | 9/2013 | Lee | H01F 17/04 310/366 |

FOREIGN PATENT DOCUMENTS

| | | | | | |
|---|---|---|---|---|---|
| JP | 2002-064002 | A | | 2/2002 | |
| JP | 2003-037001 | A | | 2/2003 | |
| JP | 2004-140285 | A | | 5/2004 | |
| JP | 2005-085865 | A | | 3/2005 | |
| JP | 2005-223272 | A | | 8/2005 | |
| JP | 2009-141171 | A | | 6/2009 | |
| JP | 2010-62407 | A | | 3/2010 | |
| JP | 4745027 | B2 | | 8/2011 | |
| JP | 4881557 | B2 | | 2/2012 | |
| JP | 2018-082141 | A | | 5/2018 | |
| KR | 2000-0022053 | A | | 4/2000 | |
| KR | 10-2018-0054257 | A | | 5/2018 | |
| KR | 1020180054257 | | * | 5/2018 | H01C 17/28 |
| WO | 2006/011425 | A1 | | 2/2006 | |

OTHER PUBLICATIONS

Japanese Office Action dated Jul. 7, 2020 issued in Japanese Patent Application No. 2019-043929 (with English translation).

* cited by examiner

ELECTRONIC COMPONENT AND MANUFACTURING METHOD THEREOF

CROSS-REFERENCE TO RELATED APPLICATION(S)

This application claims benefit of priority to Korean Patent Application No. 10-2018-0110896 filed on Sep. 17, 2018 in the Korean Intellectual Property Office, the disclosure of which is incorporated herein by reference in its entirety.

TECHNICAL FIELD

The present disclosure relates to a thin film electronic component and a manufacturing method thereof.

BACKGROUND

Miniaturization of electronic devices and reductions in manufacturing costs thereof are continuously required. Therefore, miniaturization, thinning, and reductions of manufacturing costs are also continuously required for various electronic components applied to the electronic devices.

In order to miniaturize and thin electronic components, thin film electronic components having thinly formed electrodes and various patterns included in the electronic components have been widely developed. However, in the case of conventional thin type electronic components, expensive equipment is required and manufacturing costs thereof are thus increased.

SUMMARY

An aspect of the present disclosure may provide a manufacturing method of an electronic component capable of reducing manufacturing costs of the electronic component while miniaturizing and thinning the electronic component.

An aspect of the present disclosure may provide an electronic component manufactured according to the manufacturing method of the electronic component.

According to an aspect of the present disclosure, an electronic component may include a substrate; a conductor pattern portion disposed on the substrate and extending in a first direction; a first electrode pattern and a second electrode pattern disposed at opposite ends of the conductor pattern portion in the first direction, respectively, and disposed on the conductor pattern portion; and at least one dummy electrode pattern disposed to be spaced apart from the first electrode pattern and the second electrode pattern and disposed on the substrate. A width, in a second direction different from the first direction, of the first electrode pattern may be substantially the same as a width, in the second direction, of a portion of the conductor pattern portion in contact with the first electrode pattern, and a width, in the second direction, of the second electrode pattern may be substantially the same as a width, in the second direction, of a portion of the conductor pattern portion in contact with the second electrode pattern.

According to another aspect of the present disclosure, a manufacturing method of an electronic component may include forming at least one first paste portion extending in a first direction on a substrate; forming a conductor film on the substrate on which the at least one first paste portion is formed; converting the conductor film to at least one primary conductor pattern extending in the first direction on the substrate, by removing the at least one first paste portion and portions of the conductor film disposed on the at least one first paste portion; and forming a plurality of primary electrode patterns having at least a portion overlapping the at least one primary conductor pattern.

According to another aspect of the present disclosure, an electronic component may include: a substrate; a conductor pattern portion disposed on the substrate and extending in a first direction; a first electrode pattern and a second electrode pattern disposed at opposite ends of the conductor pattern portion in the first direction, respectively, and disposed on the conductor pattern portion; first and second dummy electrode patterns disposed on opposite sides of the first electrode pattern in a second direction different from the first direction; and third and fourth dummy electrode patterns disposed on opposite sides of the second electrode pattern in the second direction. The first to fourth dummy electrode patterns and the first and second electrode patterns may be made of a same material, and the first to fourth dummy electrode patterns may be disposed on a level lower than that of the first and second electrode patterns with respect to a surface of the substrate on which the conductor pattern portion is disposed.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

In addition, as an example of an electronic component, a thin film chip resistor will hereinafter be described. However, the electronic component according to the present disclosure is not limited to the resistor, but may include various types of electronic components such as a chip inductor, a chip capacitor, and the like.

FIGS. 1A through 1I are views illustrating a manufacturing method of an electronic component according to an exemplary embodiment in the present disclosure.

Figure 1A:
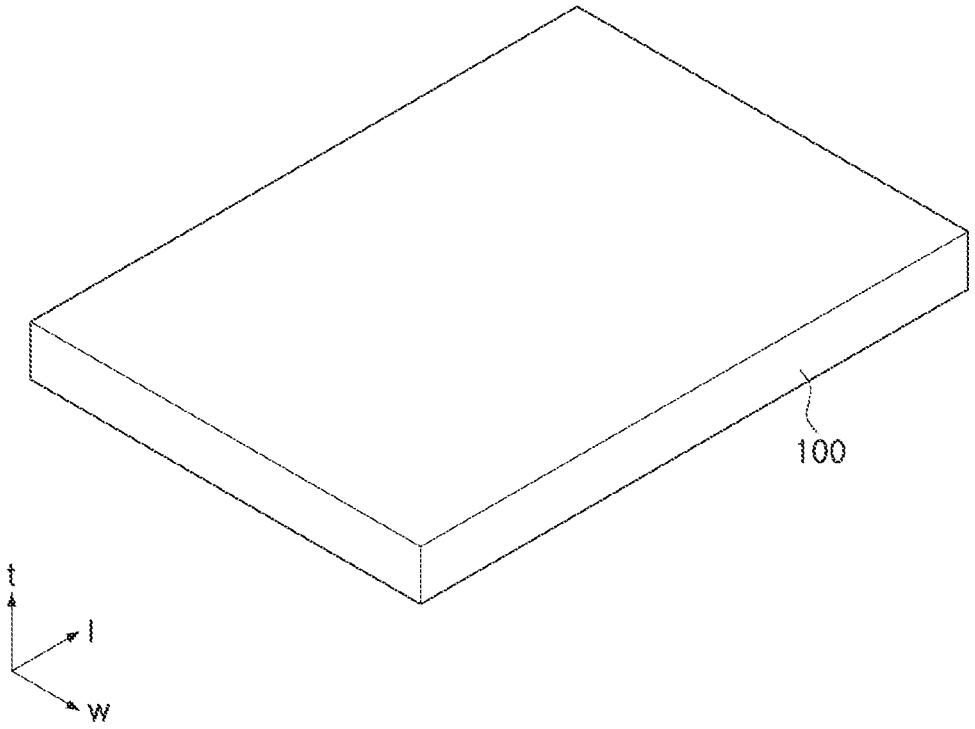
FIGS. 1A through 1I are views illustrating a manufacturing method of an electronic component according to an exemplary embodiment in the present disclosure.

First, a substrate 100 may be prepared (FIG. 1A). In the drawings, t refers to a thickness direction, l refers to a length direction, and w refers to a width direction. (Hereinafter, this will be applied to all drawings in the same manner).

Figure 1B:
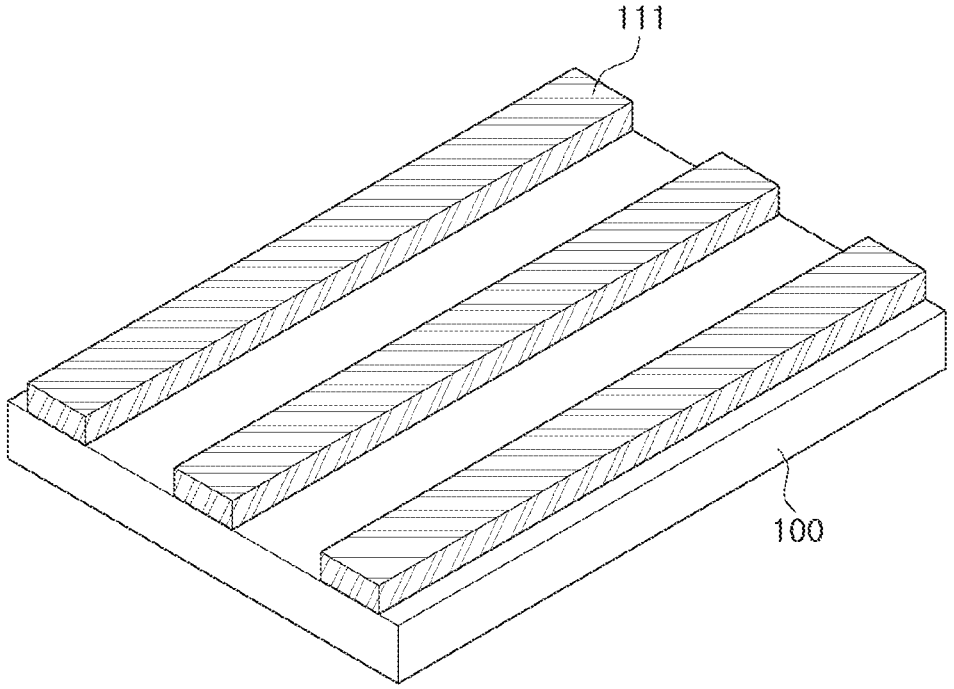

Next, a first paste portion 111 forming a primary resistance pattern may be formed on the substrate 100 (FIG. 1B). Here, the first paste portions 111 may be formed by a screen print method. The first paste portions 111 may have the form of at least one stripe extending in a first direction. The first direction may be a length direction of the substrate 100. In addition, the first paste portions 111 may be a mixture of an organic material and an inorganic material, and may be removed by an organic material remover.

Figure 1C:
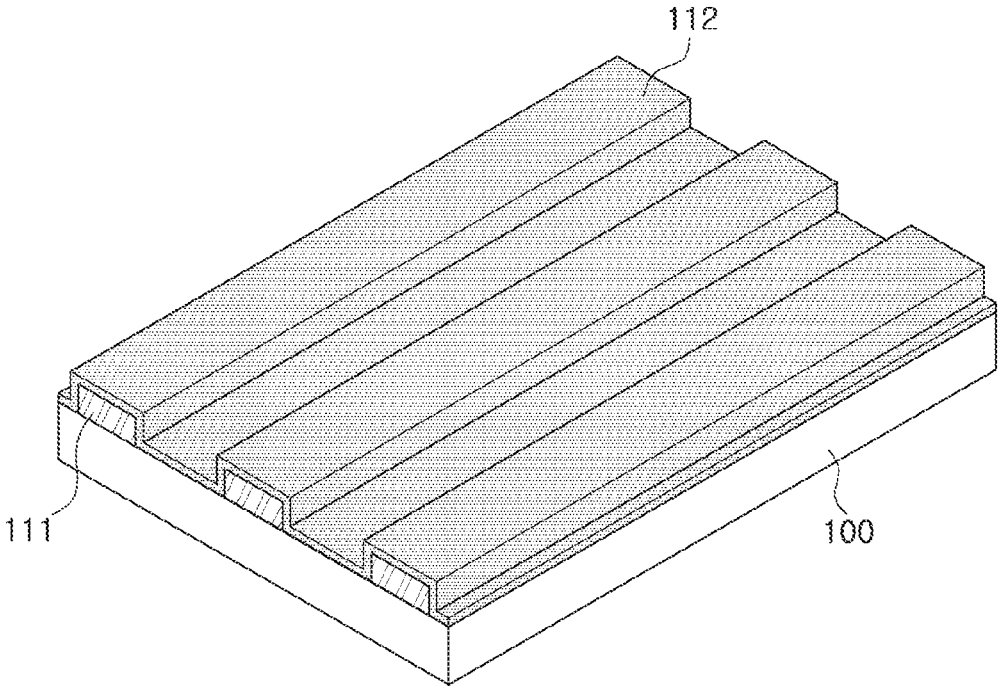

Next, a resistive film 112 may be formed on the substrate 100 on which the first paste portion 111 is formed (FIG. 1C). For example, the resistive film 112 may be formed by a thin film sputtering method. Here, the resistive film 112 may be formed on the front surface of the substrate 100 on which the first paste portion 111 is formed. In addition, the resistive film 112 may be a nickel-chromium (NiCr) based alloy or various alloy materials including nickel (Ni) or chromium (Cr). The resistive film 112 may have substantially the same thickness on the entirety of the substrate.

Figure 1D:
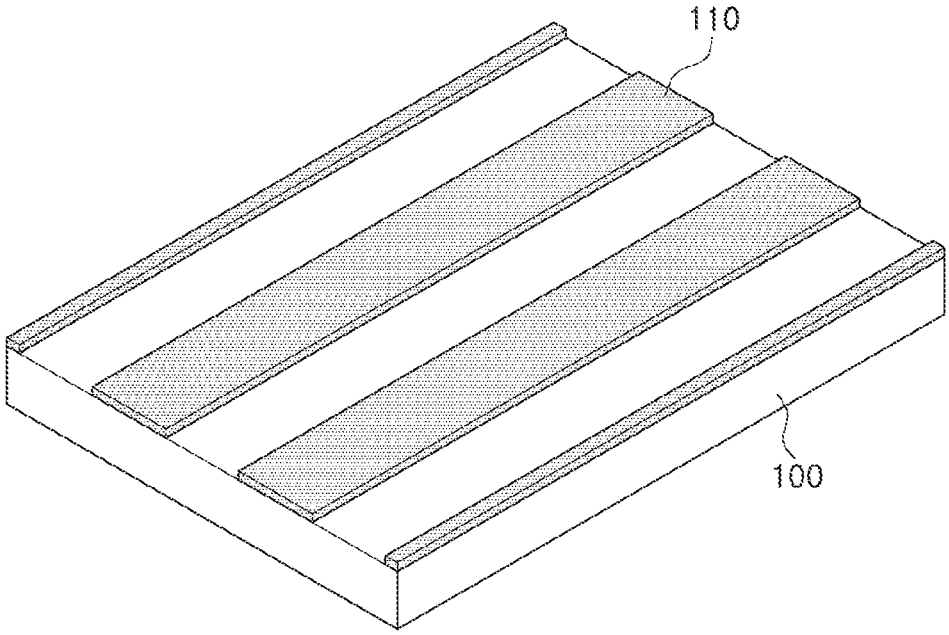

Next, the first paste portion 111 may be removed (FIG. 1D). When the first paste portion 111 is removed, a primary resistance pattern 110 may be formed on the remaining portions except for portions on which the first paste portion 111 is present. Therefore the primary electrode pattern 110 may have the form of at least one stripe extending in a first direction. The first direction may be a length direction of the substrate 100. As described above, the first paste portion 111 may be removed by using the organic material remover (e.g., an organic material removing solution). In this case, portions of the resistive film 112 disposed on or supported by the first paste portion 111 may be removed and the remaining portions of the resistive film 112 may become the primary electrode pattern 110. A resistance portion or a resistance pattern may be alternatively named as a conductor portion or a conductor pattern, as the resistance portion or the resistance pattern is made of an electrically conductive material with resistivity. Such a resistance portion (or a conductor portion) or a resistance pattern (or a conductor pattern) provides resistance and also electrically conductive. The resistance portion (or the resistance pattern) and the conductor portion (or the conductor pattern) may be exchangeable.

Figure 1E:
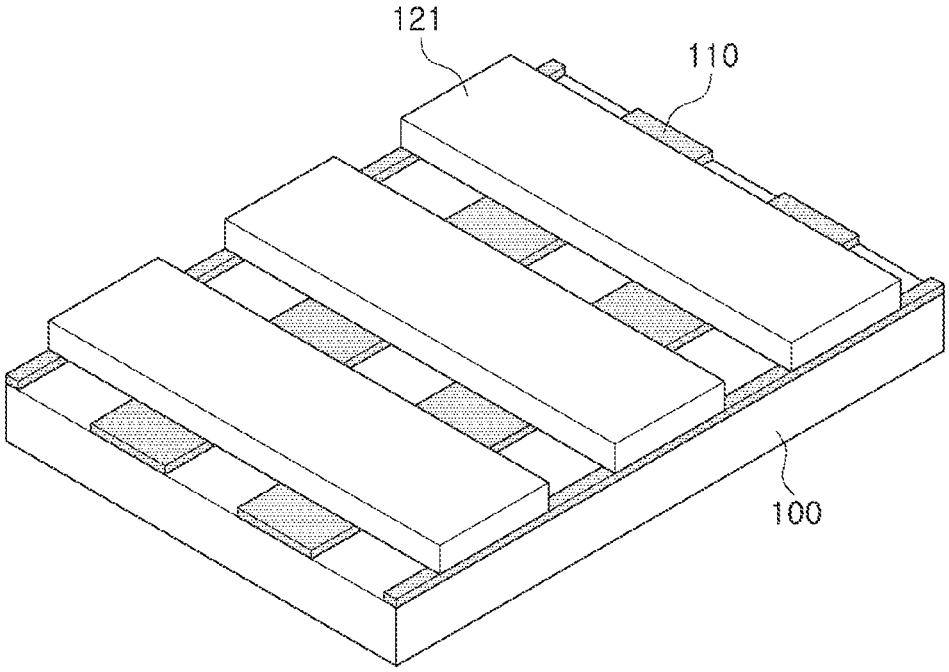

Next, a second paste portion 121 forming a primary electrode pattern may be formed on the substrate 100 on which the primary resistance pattern 110 is formed (FIG. 1E). Here, the second paste portion 121 may be formed by a screen print method. In addition, the second paste portion 121 may have the form of at least one stripe extending in a second direction different from the first direction. The second direction may be a width direction of the substrate 100. In addition, the second paste portion 121 may be a mixture of an organic material and an inorganic material, and may be removed by an organic material remover.

Figure 1F:
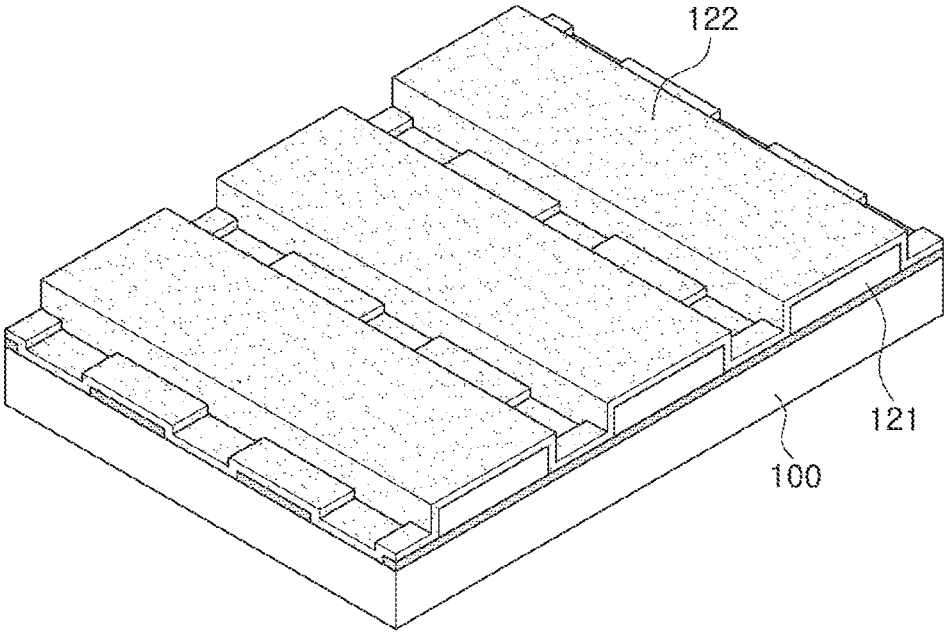

Next, an electrode film 122 may be formed on the substrate 100 on which the primary resistance pattern 110 and the second paste portion 121 are formed (FIG. 1F). For example, the electrode film 122 may be formed by a thin film sputtering method. Here, the electrode film 122 may be formed on the front surface of the substrate 100 on which the primary resistance pattern 110 and the second paste portion 121 are formed. In addition, the electrode film 122 may include an underlayer including nickel (Ni), chromium (Cr), and/or nickel-chromium (NiCr), and an electrode layer including a metal having excellent electrical conductivity such as copper (Cu), silver (Ag), gold (Au), and/or platinum (Pt). The underlayer may secure adhesion and the electrode layer may substantially serve as an electrode. The electrode film 122 may have substantially the same thickness on the entirety of the substrate 100. In addition, the electrode film 122 may have a thickness greater than that of the resistive film 112. Therefore, a thickness of an electrode pattern in the electrode component may be greater than that of a resistance pattern.

Figure 1G:
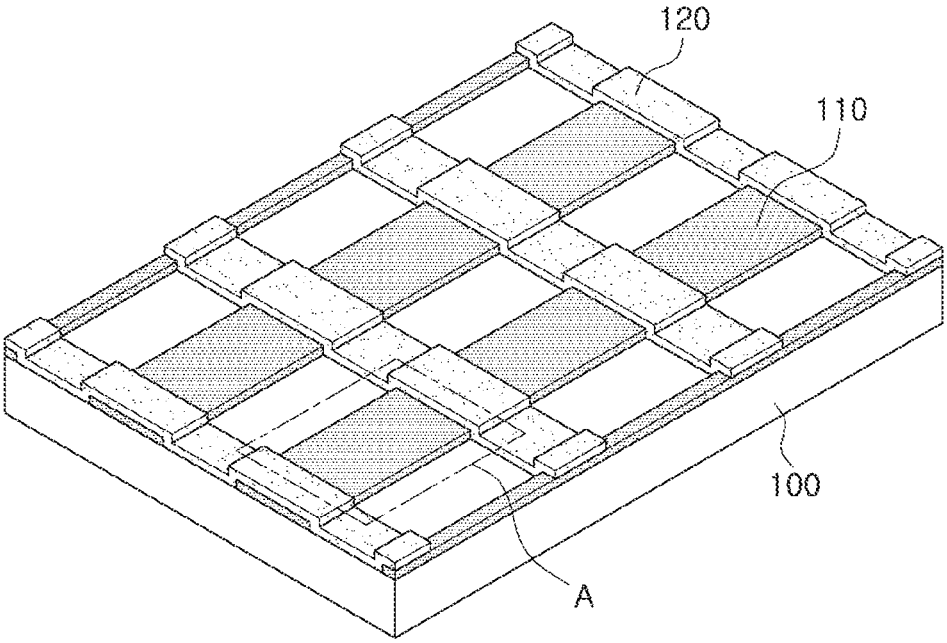

Next, the second paste portion 121 may be removed (FIG. 1G). When the second paste portion 121 is removed, a primary electrode pattern 120 may be formed on the remaining portions except for portions on which the second paste portion 121 is present. The primary electrode pattern 120 may have the form of at least one stripe overlapping the primary resistance pattern and extending in the second direction. The second direction may be the width direction of the substrate 100. As described above, the second paste portion 121 may be removed by using the organic material remover (e.g., an organic material removing solution). That is, the second paste portion 121 may be selectively removed without damaging the primary resistance pattern 110 formed below the second paste portion 121 by removing the second paste portion 121 in which the organic material and the inorganic material are mixed by using the organic material remover.

Figure 1H:
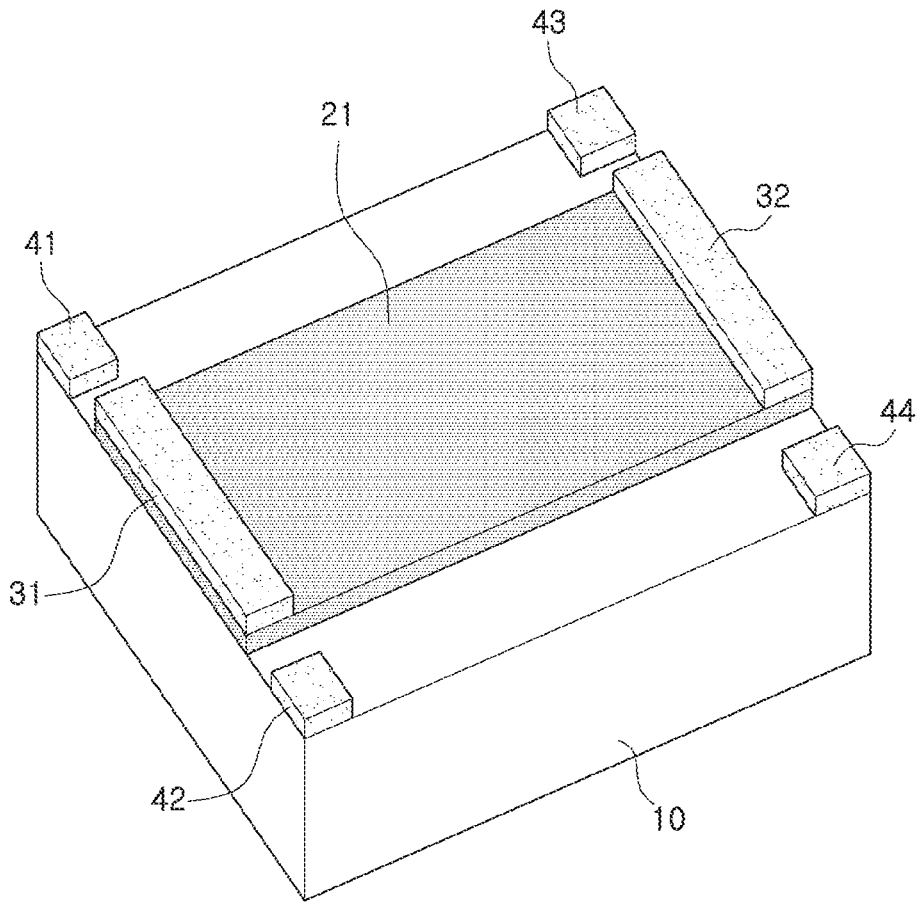
Figure 1I:
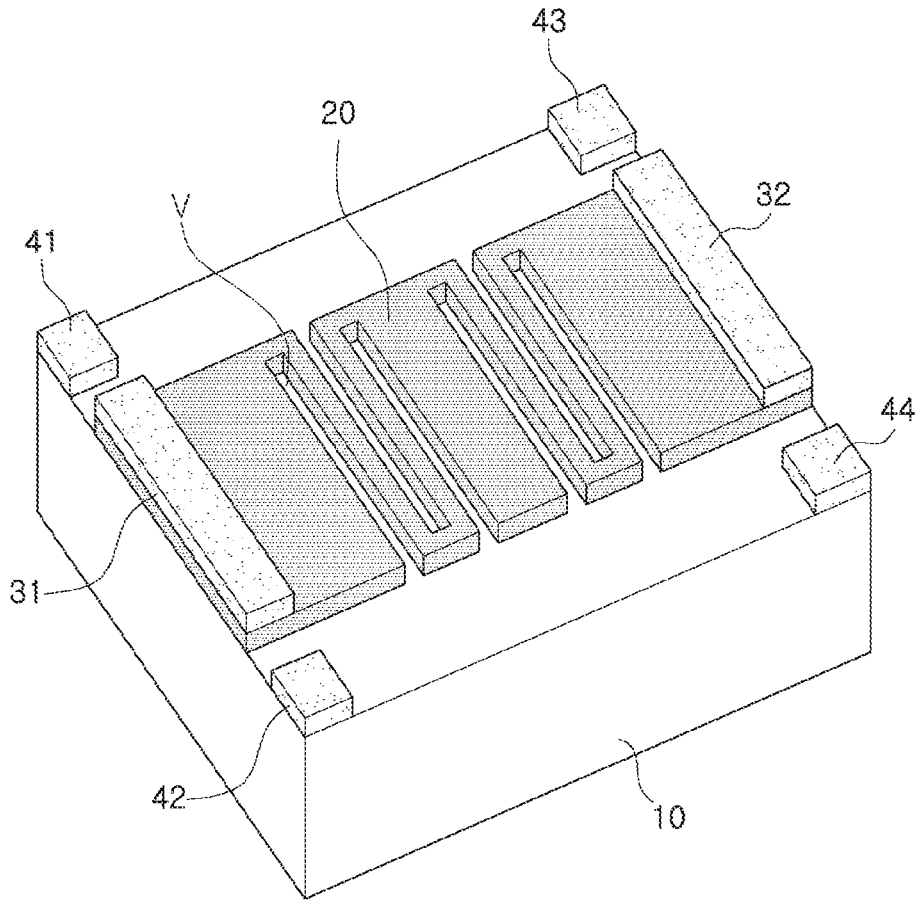

Next, a width of the primary resistance pattern 110 may be adjusted (FIG. 1H). (Hereinafter, FIGS. 1H and 1I illustrate a region A in FIG. 1G, that is, one chip resistor. According to an exemplary embodiment in the present disclosure, a plurality of chip resistors may be manufactured by cutting out the substrate 100 on which the primary resistance pattern 110 and the primary electrode pattern 120 illustrated in FIG. 1H are formed along dotted lines). For example, a secondary resistance pattern 21 may be formed by adjusting the width of the primary resistance pattern 110 with laser. More specifically, the secondary resistance pattern 21 may be formed by removing at least a portion of the primary resistance pattern extending in the first direction (e.g., the length direction of the substrate 10) with the laser. Here, a portion of the primary electrode pattern 120 may be removed while adjusting the width of the primary resistance pattern with the laser. Thereby, the chip resistor according to an exemplary embodiment in the present disclosure may include a first dummy electrode pattern 41 and a second dummy electrode pattern 42 formed at opposite sides of a first electrode pattern 31 in the second direction (e.g., the width direction of the substrate 10) and separated from the first electrode pattern 31, and a third dummy electrode pattern 43 and a fourth dummy electrode pattern 44 formed at opposite sides of a second electrode pattern 32 in the second direction (e.g., the width direction of the substrate 10) and separated from the second electrode pattern 32, in addition to the first electrode pattern 31 and the second electrode pattern 32 that are disposed at opposite ends of the chip resistor in the first direction (e.g., opposite ends of the substrate 10 in the length direction thereof). Since the first and second electrode patterns 31 and 32 are disposed on the secondary resistance pattern 21, the first and second electrode patterns 31 and 32 are spaced apart from the substrate 10. On the other hand, the first to fourth dummy electrode patterns 41 to 44 may be formed directly on the substrate 10, or may be formed on, for example, an insulating layer, which is commonly disposed between the substrate and the secondary resistance pattern 21. Thus, a distance from each of the first and second electrode patterns 31 and 32 may be greater than distance from each of the first to fourth dummy electrode patterns 41 to 44 to the substrate. In this case, the first to fourth dummy electrode patterns 41 to 44 may be disposed on a level lower than that of the first and second electrode patterns 31 and 32 with respect to a surface of the substrate 10 on which the primary resistance pattern 110 is disposed.

Next, a resistance portion 20 of the chip resistor may be formed by forming at least one pattern groove V in the secondary resistance pattern 21 (FIG. 1I). That is, at least one pattern groove V may be formed in the secondary resistance pattern 21 to adjust a resistance value of the chip resistor. The pattern groove V may be implemented in various forms, for example, I cut, L cut, double cut, or I cut of a zigzag shape.

As the laser used at the time of adjusting the width of the primary resistance pattern, a laser having a relatively large size of spot or a high power based laser may be applied. In addition, the laser used at the time of forming the pattern groove V in the secondary resistance pattern 21 may have a relatively small size of spot.

Figure 2A:
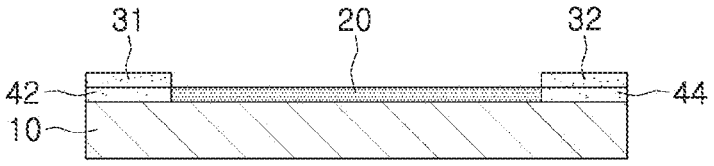
FIGS. 2A through 2C are views schematically illustrating an electronic component manufactured according to the manufacturing method of the electronic component according to an exemplary embodiment in the present disclosure illustrated in FIGS. 1A through 1I.
Figure 2B:
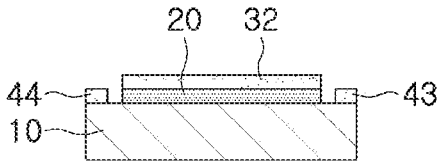
Figure 2C:
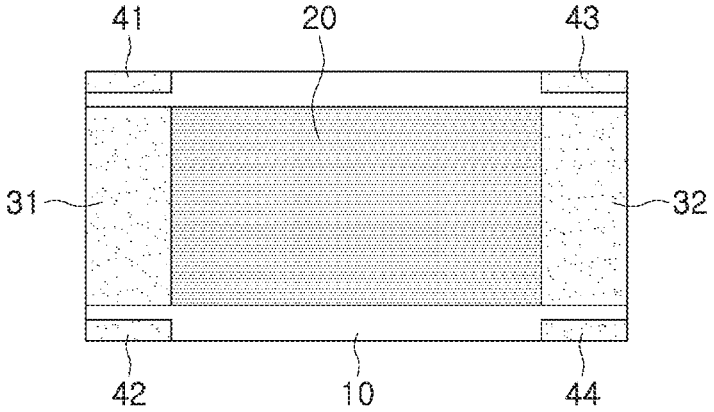

FIGS. 2A through 2C are views schematically illustrating an electronic component manufactured according to the manufacturing method of the electronic component according to an exemplary embodiment in the present disclosure illustrated in FIGS. 1A through 1I. FIG. 2A illustrates a front view when viewed in the width direction of the electronic component, FIG. 2B is a side view when viewed in the length direction thereof, and FIG. 2C illustrates a plan view when viewed in the thickness direction thereof.

As illustrated in FIGS. 2A through 2C, the electronic component according to an exemplary embodiment in the present disclosure may include the substrate 10, the resistance portion 20 disposed on the substrate 10 and extending in the first direction (e.g., the length direction of the substrate), the first electrode pattern 31 and the second electrode pattern 32 disposed at opposite ends of the resistance portion 20 in the first direction and disposed on the resistance portion 20, the first dummy electrode pattern 41 and the second dummy electrode pattern 42 disposed to be spaced apart from the first electrode pattern 31 at opposite sides of the first electrode pattern 31 in the second direction (e.g., the width direction of the substrate) different from the first direction and disposed on the substrate 10, and the third dummy electrode pattern 43 and the fourth dummy electrode pattern 44 disposed to be spaced apart from the second electrode pattern 32 at opposite sides of the second electrode pattern 32 in the second direction (e.g., the width direction of the substrate) and disposed on the substrate 10.

As described above, the first electrode pattern 31 and the second electrode pattern 32 may be formed in the process of forming the secondary resistance pattern by removing a portion of the primary resistance pattern after forming the primary electrode pattern on the primary resistance pattern. Therefore, a width of the first electrode pattern 31 may be substantially the same as a width of a portion of the resistance portion 20 on which the first electrode pattern 31 is formed. Similarly, a width of the second electrode pattern 32 may be substantially the same as a width of a portion of the resistance portion 20 on which the second electrode pattern 32 is formed. A dimension of one element being substantially the same as another dimension of another element may mean that the dimension of the one element is the same as the other dimension of the other element, or there is a tolerance or an error, due to variations in manufacturing or measurement recognizable by one of ordinary skill in the art, between the dimension of the one element and the other dimension of the other element.

FIGS. 3A through 3D are views illustrating a manufacturing method of an electronic component according to an exemplary embodiment in the present disclosure. According to the manufacturing method of the electronic component according to an exemplary embodiment in the present disclosure, a coating layer may be formed before forming the resistive film.

First, a first paste portion 211 may be formed on a substrate 200. A process of forming the first paste portion 211 may be the same as that described with reference to FIGS. 1A and 1B.

Figure 3A:
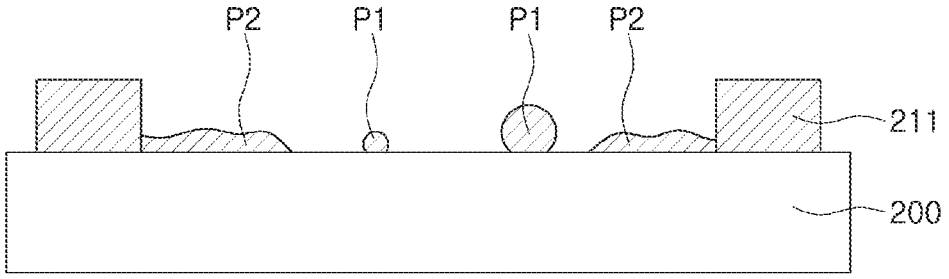
FIGS. 3A through 3D are views illustrating a manufacturing method of an electronic component according to an exemplary embodiment in the present disclosure.

As illustrated in FIG. 3A, particles P1 may also be attached to the substrate 200 in the process of forming the first paste portion 211, and the residual pastes P2 may also be attached to the substrate at undesirable positions by a paste flow. The particles P1 or the residual pastes P2 may provide a cause for deteriorating the performance of the completed chip resistor. For example, the particles P1 or the residual pastes P2 may cause a pinhole or the like in the resistive film in the process of forming the resistive film and removing the first paste portion later.

Figure 3B:
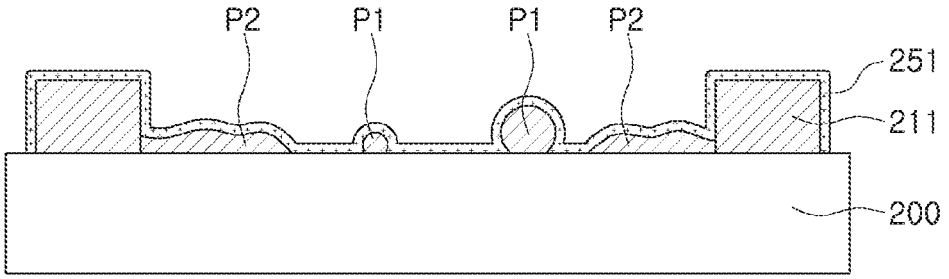

According to an exemplary embodiment in the present disclosure, after the first paste portion 211 is formed, a coating film 251 may be formed (FIG. 3B). The coating film 251 may be formed by a chemical vapor deposition (CVD) method. The coating film 251 may be an oxide film including silicon dioxide ($SiO_2$) and/or aluminum oxide ($Al_2O_3$). By forming the coating film 251, reliability of the electronic component (e.g., the chip resistor) may be improved by reducing the deterioration of the adhesion of the resistance pattern and an occurrence of other stress by the particles P1, the residual pastes P2, and other foreign materials.

Figure 3C:
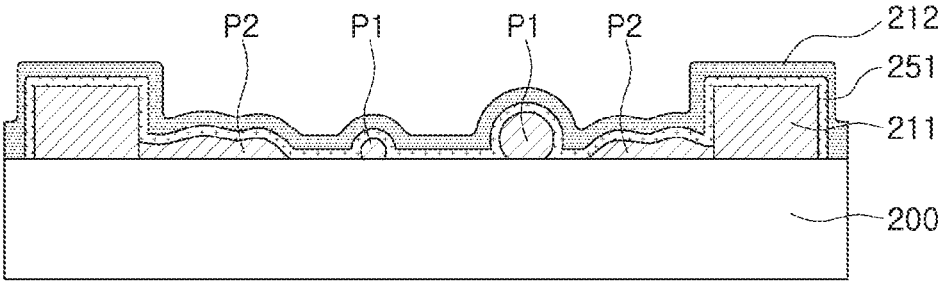

Next, a resistive film 212 may be formed on the substrate 200 on which the first paste portion 211 and the coating film 251 are formed (FIG. 3C). A process of forming the resistive film 212 may be the same as that described with reference to FIG. 1C.

Figure 3D:
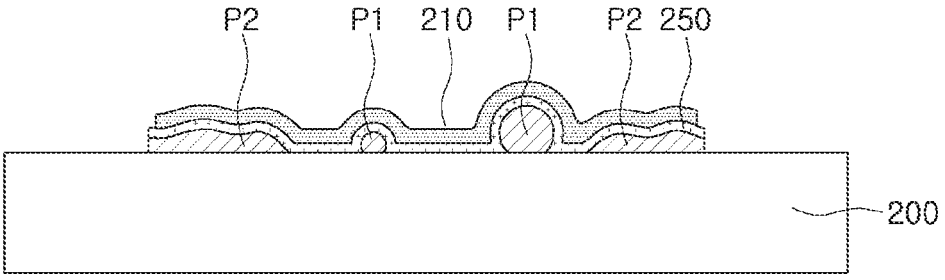

Next, the first paste portion 211 may be removed (FIG. 3D). A process of removing the first paste portion 211 may be the same as that described with reference to FIG. 1D. Here, the particles P1 or the residual pastes P2 may be completely surrounded by the resistive film 212 due to a presence of the coating film 251. Therefore, during the process of removing the first paste portion 211, the particles P1 or the residual pastes P2 may not be removed. That is, since an end portion of the first paste portion 211 in the length direction thereof is exposed to the remover, but the particles P1 or the residual pastes P2 are not exposed to the remover due to the coating film 251 formed on the substrate 200, only the first paste portion 211 may be selectively removed. The particles P1 or the residual pastes P2 may be randomly distributed on the substrate 200. As a result, a surface profile of a stacked structure including the particles P1 or the residual pastes P2, the coating film 250, and the first resistance pattern 210 may include randomly distributed protrusions in a region extending between the first and second electrode patterns.

As a result, according to an exemplary embodiment in the present disclosure, the coating film 250 (e.g., the remaining coating film 251 after the selective removal process to remove the end portions of the first paste portion 211) may be present on the first resistance pattern 210 and the substrate 200.

Thereafter, the processes described with reference to FIGS. 1E through 1I may be additionally performed.

Although not illustrated, the coating film may also be additionally formed after forming the second paste portion as described in FIG. 1E and before forming the electrode film as described in FIG. 1F.

Figure 4A:
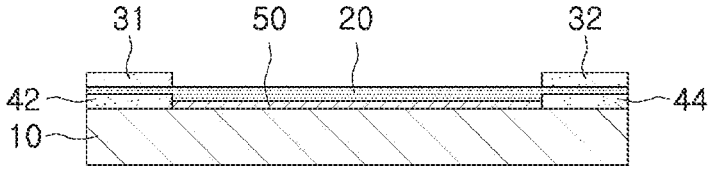
FIGS. 4A through 4C are views schematically illustrating an electronic component manufactured according to the manufacturing method of the electronic component according to an exemplary embodiment in the present disclosure illustrated in FIGS. 3A through 3D, and FIGS. 1E through 1I.
Figure 4B:
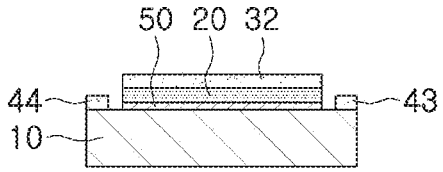
Figure 4C:
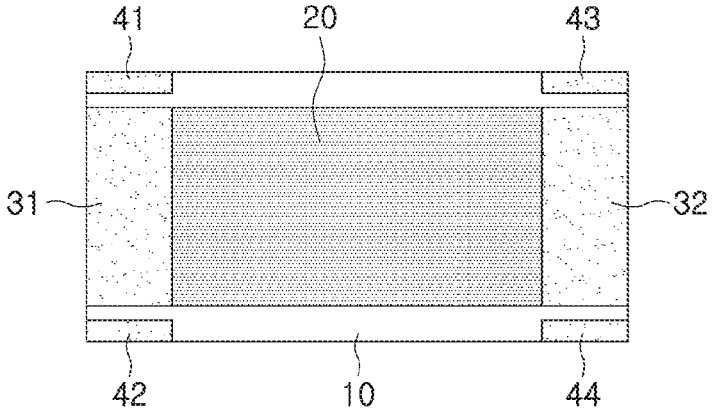

FIGS. 4A through 4C are views schematically illustrating an electronic component manufactured according to the manufacturing method of the electronic component according to an exemplary embodiment in the present disclosure illustrated in FIGS. 3A through 3D, and FIGS. 1E and 1I. FIG. 4A illustrates a front view when viewed in the width direction of the electronic component, FIG. 4B is a side view when viewed in the length direction thereof, and FIG. 4C illustrates a plan view when viewed in the thickness direction thereof.

As illustrated in FIGS. 4A through 4C, the electronic component according to an exemplary embodiment in the present disclosure may include the substrate 10, the resistance portion 20 disposed on the substrate 10 and extending in the first direction (e.g., the length direction of the substrate), the coating film 50 disposed between the substrate 10 and the resistance portion 20, the first electrode pattern 31 and the second electrode pattern 32 disposed at opposite ends of the resistance portion 20 in the first direction and disposed on the resistance portion 20, the first dummy electrode pattern 41 and the second dummy electrode pattern 42 disposed to be spaced apart from the first electrode pattern 31 at opposite sides of the first electrode pattern 31 in the second direction (e.g., the width direction of the substrate) different from the first direction and disposed on the substrate 10, and the third dummy electrode pattern 43 and the fourth dummy electrode pattern 44 disposed to be spaced apart from the second electrode pattern 32 at opposite sides of the second electrode pattern 32 in the second direction (e.g., the width direction of the substrate) different from the first direction and disposed on the substrate 10.

Figure 5A:
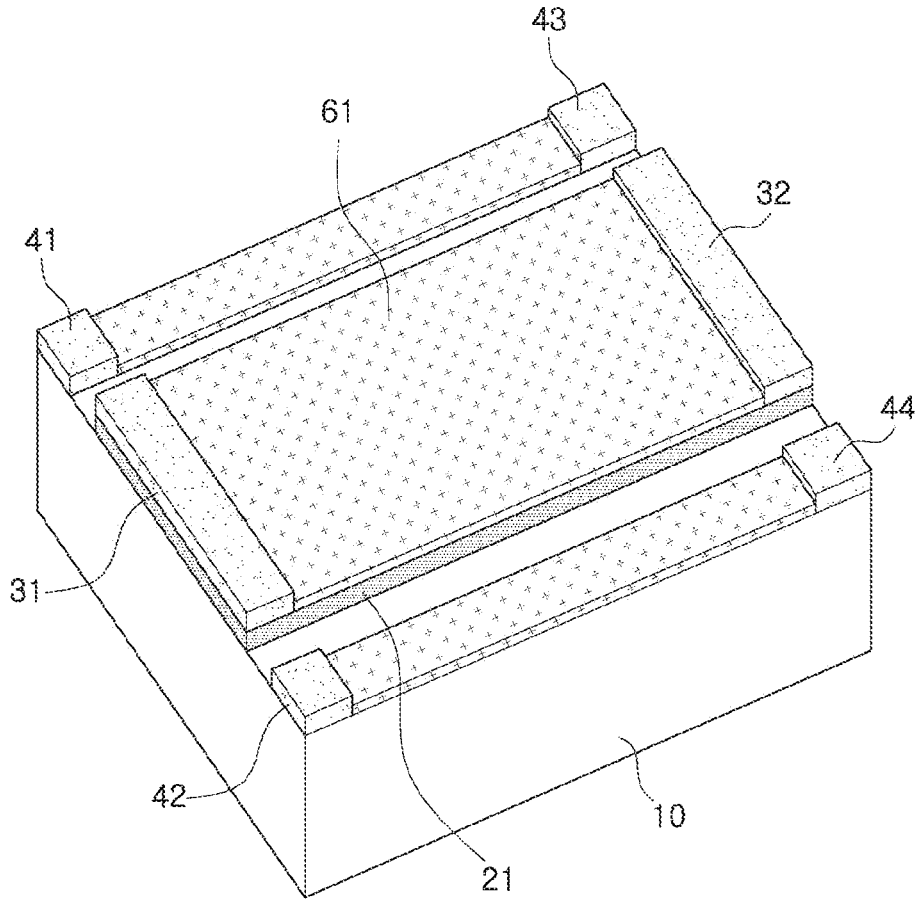
FIGS. 5A and 5B are views illustrating a manufacturing method of an electronic component according to an exemplary embodiment in the present disclosure.
Figure 5B:
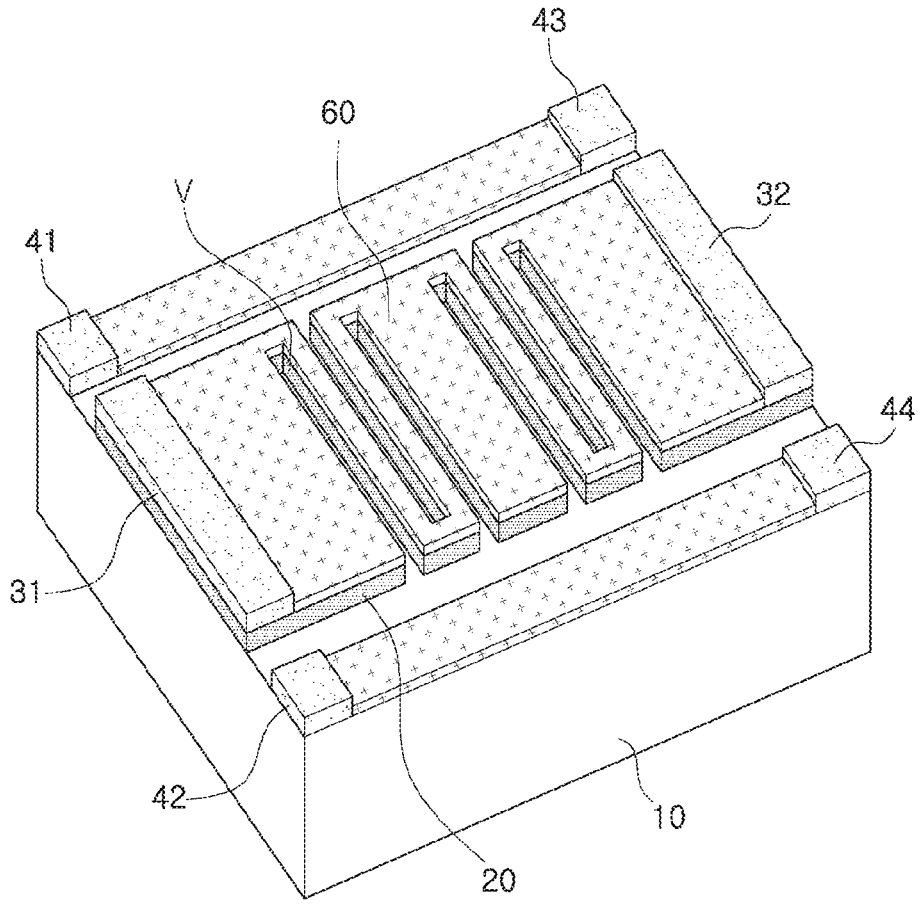

FIGS. 5A and 5B are views illustrating a manufacturing method of an electronic component according to an exemplary embodiment in the present disclosure.

According to the manufacturing method of an electronic component according to an exemplary embodiment in the present disclosure, after the primary resistance pattern and the primary electrode pattern are formed, that is, after the processes described with reference to FIGS. 1A through 1G are completed, an inorganic protective film (e.g., an insulating layer) 61 may be formed on a portion at which the primary resistance pattern 110 (FIG. 1G) is exposed. The inorganic protective film 61 may include oxide including silicon dioxide ($SiO_2$), aluminum oxide ($Al_2O_3$), nitride, or the like. The inorganic protective film may have mechanical strength greater than that of the resistance pattern or the electrode. In addition, the inorganic protective film 61 may be an insulator.

After the inorganic protective film 61 is formed, a secondary resistance pattern 21 may be formed by adjusting a width of the primary resistance pattern (FIG. 5A). A process of adjusting the width of the primary resistance pattern may be the same as that described with reference to FIG. 1H.

Next, a resistance portion 20 of the chip resistor may be formed by forming at least one pattern groove V in the secondary resistance pattern 21 on which the inorganic protective film 61 is formed (FIG. 5B). This process may be the same as that described with reference to FIG. 1I.

Figure 6A:
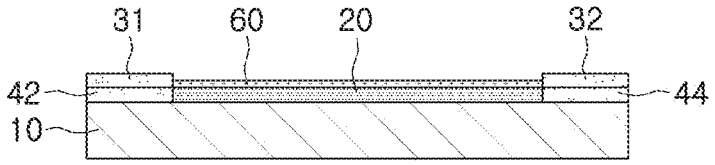
FIGS. 6A through 6C are views schematically illustrating an electronic component manufactured according to the manufacturing method of the electronic component according to an exemplary embodiment in the present disclosure illustrated in FIGS. 1A through 1H, 5A, and 5B.
Figure 6B:
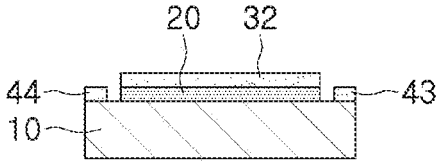
Figure 6C:
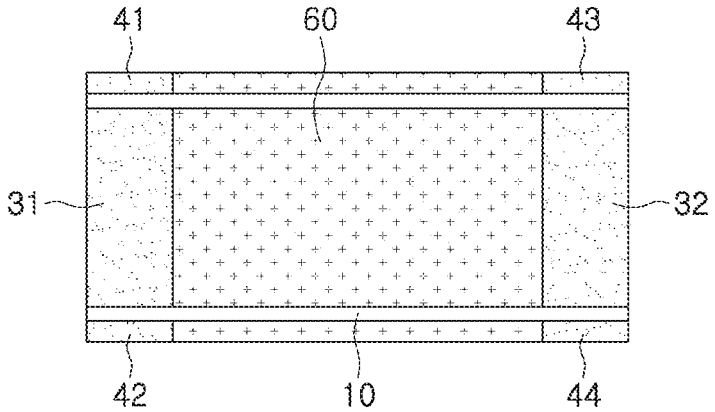

FIGS. 6A through 6C are views schematically illustrating an electronic component manufactured according to the manufacturing method of the electronic component according to an exemplary embodiment in the present disclosure illustrated in FIGS. 1A through 1H, and FIGS. 5A and 5B. FIG. 6A illustrates a front view when viewed in the width direction of the electronic component, FIG. 6B is a side view when viewed in the length direction thereof, and FIG. 6C illustrates a plan view when viewed in the thickness direction thereof.

As illustrated in FIGS. 6A through 6C, the electronic component according to an exemplary embodiment in the present disclosure may include the substrate 10, the resistance portion 20 disposed on the substrate 10 and extending in the first direction (e.g., the length direction of the substrate), the inorganic protective film 60 disposed in a space between the first electrode pattern 31 and the second electrode pattern 32 on the resistance portion 20, the first electrode pattern 31 and the second electrode pattern 32 disposed at opposite ends of the resistance portion 20 in the first direction and disposed on the resistance portion 20, the first dummy electrode pattern 41 and the second dummy electrode pattern 42 disposed to be spaced apart from the first electrode pattern 31 at opposite sides of the first electrode pattern 31 in the second direction (e.g., the width direction of the substrate) different from the first direction and disposed on the substrate 10, and the third dummy electrode pattern 43 and the fourth dummy electrode pattern 44 disposed to be spaced apart from the second electrode pattern 32 at opposite sides of the second electrode pattern 32 in the second direction (e.g., the width direction of the substrate) different from the first direction and disposed on the substrate 10.

As described above, in the state in which the primary resistance pattern is formed and the inorganic protective film is formed on the primary resistance pattern, a secondary resistance pattern may be formed by adjusting the width of the primary resistance pattern. Therefore, a width of the inorganic protective film 61 may be substantially the same as the width of the resistance portion 20. In addition, in the state in which the inorganic protective film is formed, the resistance portion may be formed by forming a pattern groove in the second resistance pattern. Therefore, the inorganic protective film 61 may be formed with the pattern groove which is substantially the same as the pattern groove formed in the resistance portion.

Although not illustrated in FIGS. 6A through 6C, the electronic component according to an exemplary embodiment in the present disclosure may further include the coating film 50 (FIGS. 4A through 4C) disposed between the substrate 10 and the resistance portion 20.

According to an exemplary embodiment in the present disclosure illustrated in FIGS. 5A through 6C, after the inorganic protective film is formed on the resistive film, a laser process may be applied thereto. Therefore, an occurrence of conductive scattering materials of the resistive film and/or conductive scattering materials of the electrode may be prevented when the resistive film (or the resistance pattern) is processed with the laser. In addition, a problem of electrical characteristic instability in the chip resistor, which is the final product, that is, reliability of the product that may be caused by the conductive scattering materials of the resistive film, the conductive scattering materials of the electrode, or thin film residues that may remain on the substrate may also be improved.

In addition, although FIGS. 5A through 6C illustrate that the inorganic protective film are formed at opposite ends of the resistance portions 20 and 21 in the width direction of the resistance portions, the inorganic protective film may also be formed only on upper surfaces of the resistance portions 20 and 21.

Figure 7A:
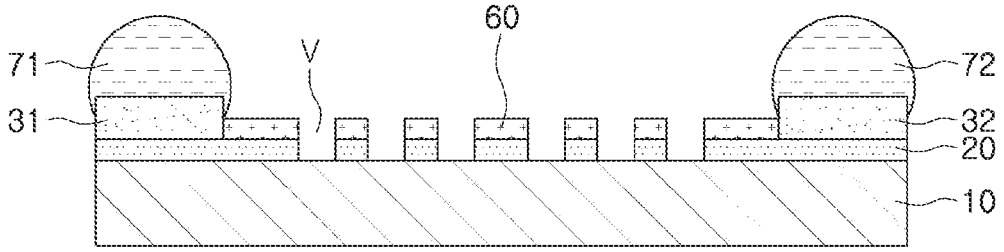
FIGS. 7A through 7C are views illustrating a manufacturing method of an electronic component according to an exemplary embodiment in the present disclosure.
Figure 7B:
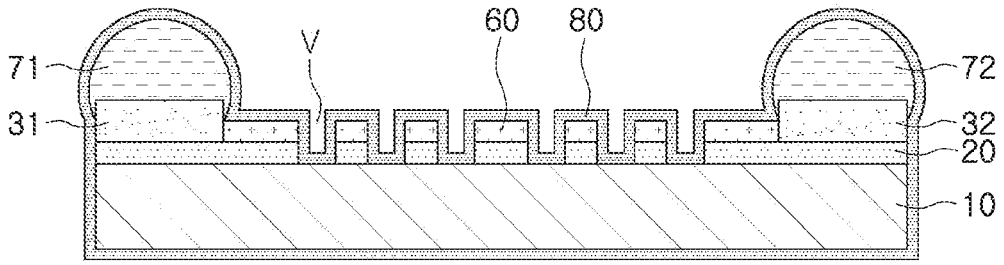
Figure 7C:
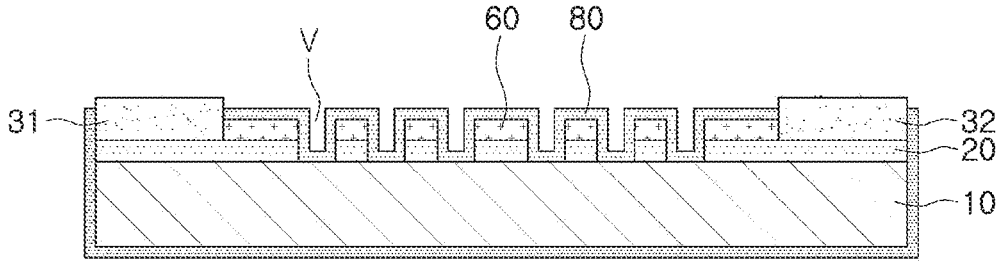

FIGS. 7A through 7C are views illustrating a manufacturing method of an electronic component according to an exemplary embodiment in the present disclosure. FIGS. 7A through 7C illustrate a cross-sectional views of a middle portion of the electronic component according to an exemplary embodiment in the present disclosure in the width direction thereof taken along the length direction thereof.

According to the manufacturing method of an electronic component according to an exemplary embodiment in the present disclosure, an additional secondary protective film may be formed on the remaining portions except for the electrode patterns.

Specifically, after forming the substrate 10, the resistance portion 20, the first electrode pattern 31, the second electrode pattern 32, and the inorganic protective film 60 are formed through the processes of FIGS. 1A through 1H, and FIGS. 5A and 5B, third paste portions 71 and 72 may be formed on the first electrode pattern 31 and the second electrode pattern 32, respectively (FIG. 7A). The third paste portions 71 and 72 may be formed by a screen print method. The third paste portions 71 and 72 may be a mixture of an organic material and an inorganic material.

Next, a secondary protective film 80 may be formed (FIG. 7B). The secondary protective film may be formed by a chemical vapor deposition (CVD) method. As illustrated in FIG. 7B, the secondary protective film 80 may be formed on exposed portions (i.e., portions in which the pattern groove V is formed) of the resistance portion 20 and the substrate 10, as well as on the inorganic protective film 60.

Next, the third paste portions 71 and 72 may be removed (FIG. 7C). The third paste portions 71 and 72 may be removed by an organic material remover.

Figure 8A:
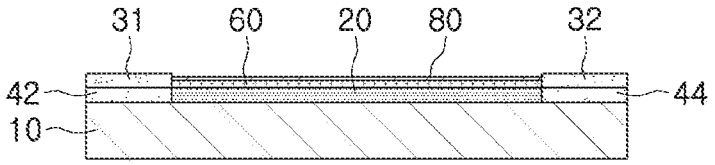
FIGS. 8A through 8C are views schematically illustrating an electronic component manufactured according to the manufacturing method of the electronic component according to an exemplary embodiment in the present disclosure illustrated in FIGS. 1A through 1H, FIGS. 5A and 5B, and FIGS. 7A through 7C.
Figure 8B:
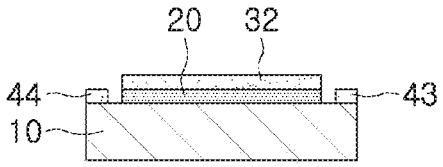
Figure 8C:
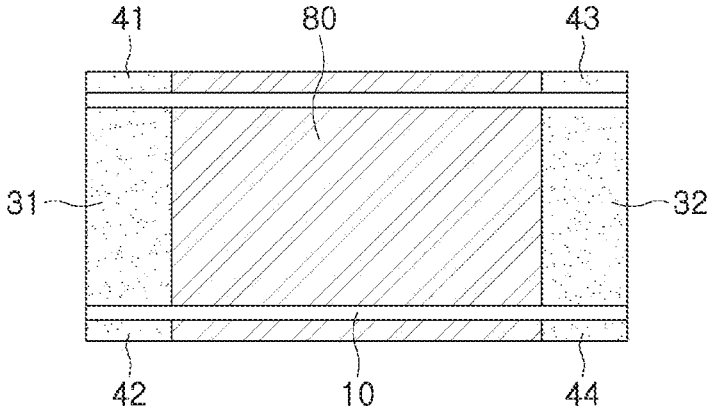

FIGS. 8A through 8C are views schematically illustrating an electronic component manufactured according to the manufacturing method of the electronic component according to an exemplary embodiment in the present disclosure illustrated in FIGS. 1A through 1H, FIGS. 5A and 5B, and FIGS. 7A through 7C. FIG. 8A illustrates a front view when viewed in the width direction of the electronic component, FIG. 8B is a side view when viewed in the length direction thereof, and FIG. 8C illustrates a plan view when viewed in the thickness direction thereof.

As illustrated in FIGS. 8A through 8C, the electronic component according to an exemplary embodiment in the present disclosure may include the substrate 10, the resistance portion 20 disposed on the substrate 10 and extending in the first direction (e.g., the length direction of the substrate), the inorganic protective film 60 disposed in the space between the first electrode pattern 31 and the second electrode pattern 32 on the resistance portion 20, the secondary protective film 80 formed on the inorganic protective film 60 and portions (i.e., portions in which the pattern groove is formed) to which the resistance portion 20 and the substrate 10 are exposed, the first electrode pattern 31 and the second electrode pattern 32 disposed at opposite ends of the resistance portion 20 in the first direction and disposed on the resistance portion 20, the first dummy electrode pattern 41 and the second dummy electrode pattern 42 disposed to be spaced apart from the first electrode pattern 31 at opposite sides of the first electrode pattern 31 in the second direction (e.g., the width direction of the substrate) different from the first direction and disposed on the substrate 10, and the third dummy electrode pattern 43 and the fourth dummy electrode pattern 44 disposed to be spaced apart from the second electrode pattern 32 at opposite sides of the second electrode pattern 32 in the second direction (e.g., the width direction of the substrate) different from the first direction and disposed on the substrate 10.

Although not illustrated in FIGS. 8A through 8C, the electronic component according to an exemplary embodiment in the present disclosure may further include the coating film 50 (FIGS. 4A through 4C) disposed between the substrate 10 and the resistance portion 20.

Although FIGS. 7A through 8C illustrate that the electronic component according to an exemplary embodiment in the present disclosure includes all the two protective films (i.e., the inorganic protective film 60 and the secondary protective film 80), the electronic component according to an exemplary embodiment in the present disclosure may also include only the secondary protective film 80.

Although not illustrated in FIGS. 2A through 2C, FIGS. 4A through 4C, FIGS. 6A through 6C, and FIGS. 8A through 8C, the electronic component according to an exemplary embodiment in the present disclosure may have at least one pattern groove formed in the resistance portion.

In addition, although not illustrated in FIGS. 2A through 2C, FIGS. 4A through 4C, FIGS. 6A through 6C, and FIGS. 8A through 8C, the electronic component according to an exemplary embodiment in the present disclosure may further include a protective film disposed on the resistance portion 20. In addition, the electronic component according to an exemplary embodiment in the present disclosure may further include a plating layer formed on at least one side of the first electrode pattern 31 and the second electrode pattern 32, for example, on the first electrode pattern 31 and the second electrode pattern 32.

In addition, although the thin film chip resistor is described as an example of the electronic component according to the present disclosure, the electronic component according to the present disclosure is not limited to the resistor. Therefore, the resistive film, the resistance pattern, and the resistance portion may be substituted with a conductor film, a conductor pattern, and a conductor pattern portion, respectively.

As set forth above, according to the exemplary embodiment in the present disclosure, the electronic component and the manufacturing method thereof may reduce the manufacturing costs of the electronic component while miniaturizing and thinning the electronic component.

While exemplary embodiments have been shown and described above, it will be apparent to those skilled in the art that modifications and variations could be made without departing from the scope of the present invention as defined by the appended claims.

What is claimed is:

1. An electronic component comprising:

a substrate;

a conductor pattern portion disposed on the substrate and extending in a first direction;

a first electrode pattern and a second electrode pattern disposed at opposite ends of the conductor pattern portion in the first direction, respectively, and disposed on the conductor pattern portion; and at least one dummy electrode pattern spaced apart from the first electrode pattern, the conductor pattern portion, and the second electrode pattern, the at least one dummy electrode pattern disposed on the substrate, wherein a width, in a second direction different from the first direction, of the first electrode pattern is substantially the same as a width, in the second direction, of a first portion of the conductor pattern portion in contact with the first electrode pattern, and a width, in the second direction, of the second electrode pattern is substantially the same as a width, in the second direction, of a second portion of the conductor pattern portion in contact with the second electrode pattern.

2. The electronic component of claim 1, wherein the at least one dummy electrode pattern includes:

a first dummy electrode pattern and a second dummy electrode pattern disposed at opposite sides of the first electrode pattern in the second direction and formed on the substrate; and a third dummy electrode pattern and a fourth dummy electrode pattern disposed at opposite sides of the second electrode pattern in the second direction and formed on the substrate, and each of the first to fourth dummy electrode patterns is spaced apart from the first electrode pattern, the conductor pattern portion, and the second electrode pattern.

3. The electronic component of claim 2, wherein each of the first to fourth dummy electrode patterns has two side surfaces flushed with side surfaces of the substrate.

4. The electronic component of claim 2, wherein the first to fourth dummy electrode patterns are disposed on corners of the substrate, respectively.

5. The electronic component of claim 1, further comprising a coating film disposed between the substrate and the conductor pattern portion.

6. The electronic component of claim 5, further comprising particles disposed on the substrate and covered by the coating film.

7. The electronic component of claim 1, further comprising a first protective film disposed on the conductor pattern portion and having a width which is substantially the same as a width of a portion of the conductor pattern portion between the first and second portions of the conductor pattern portion.

8. The electronic component of claim 7, wherein the conductor pattern portion includes at least one pattern groove, and the first protective film includes a pattern groove which is the same as the at least one pattern groove formed in the conductor pattern portion.

9. The electronic component of claim 8, further comprising a secondary protective film on the first protective film and the at least one pattern groove.

10. A manufacturing method of an electronic component, the manufacturing method comprising:

forming at least one first paste portion extending in a first direction on a substrate;

forming a conductor film on the substrate on which the at least one first paste portion is formed;

converting the conductor film to at least one primary conductor pattern extending in the first direction on the substrate, by removing the at least one first paste portion and portions of the conductor film disposed on the at least one first paste portion;

forming a plurality of primary electrode patterns having at least a portion overlapping the at least one primary conductor pattern;

forming a secondary conductor pattern by removing a portion of each of the plurality of primary conductor patterns; and forming a first electrode pattern, a second electrode pattern, and at least one dummy electrode pattern disposed at opposite ends of the secondary conductor pattern in the first direction by removing a portion of the plurality of primary electrode patterns.

11. The manufacturing method of claim 10, wherein the forming of the plurality of primary electrode patterns includes:

forming at least one second paste portion extending in a second direction different from the first direction on the substrate;

forming an electrode film on the substrate on which the at least one primary conductor pattern and the at least one second paste portion are formed; and converting the electrode film to the plurality of primary electrode patterns, by removing the at least one second paste portion and portions of the electrode film disposed on the at least one second paste portion.

12. The manufacturing method of claim 10, wherein the at least one first paste portion is formed by a printing method, and the conductor film is formed by a film sputtering method.

13. The manufacturing method of claim 10, further comprising, after the forming of the at least one first paste portion and before the forming of the conductor film, forming a coating film on the substrate on which the at least one first paste portion is formed.

14. The manufacturing method of claim 10, wherein the removing the portion of the plurality of primary electrode patterns is performed by a laser process.

15. The manufacturing method of claim 10, further comprising:

forming third paste portions on the first electrode pattern and the second electrode pattern, respectively;

forming a protective film covering the third paste portions and the secondary conductor pattern having at least one pattern groove; and removing the third paste portions and portions of the protective film covering the third paste portions, such that the secondary conductor pattern having the at least one pattern groove is covered by the remaining portion of the protective film.

16. The manufacturing method of claim 10, further comprising:

prior to forming the first electrode pattern, the second electrode pattern, and the at least one dummy electrode pattern, forming a first protective film on a portion between the plurality of primary electrode patterns on the at least one first conductor pattern.

17. The manufacturing method of claim 16, further comprising forming a conductor pattern portion by forming at least one pattern groove in the secondary conductor pattern.

18. The manufacturing method of claim 17, further comprising forming a secondary protective film on the primary protective film and a surface of the at least one pattern groove.

19. An electronic component comprising:

a substrate;

a conductor pattern portion disposed on the substrate and extending in a first direction;

a first electrode pattern and a second electrode pattern disposed at opposite ends of the conductor pattern portion in the first direction, respectively, and disposed on the conductor pattern portion;

first and second dummy electrode patterns disposed on opposite sides of the first electrode pattern in a second direction different from the first direction; and third and fourth dummy electrode patterns disposed on opposite sides of the second electrode pattern in the second direction, wherein the first to fourth dummy electrode patterns and the first and second electrode patterns are made of a same material, and the first to fourth dummy electrode patterns are disposed on a level lower than that of the first and second electrode patterns with respect to a surface of the substrate on which the conductor pattern portion is disposed.

20. The electronic component of claim 19, wherein the first and second dummy electrode patterns are aligned with each other in the second direction, and the third and fourth dummy electrode patterns are aligned with each other in the second direction.

21. The electronic component of claim 19, further comprising a coating film disposed between the substrate and the conductor pattern portion.

22. The electronic component of claim 21, further comprising particles disposed on the substrate and covered by the coating film.

23. The electronic component of claim 19, further comprising a first protective film covering the conductor pattern portion.

24. The electronic component of claim 23, wherein the conductor pattern portion includes at least one pattern groove, and the electronic component further comprises a second protective film disposed on the first protective film and directly covering side surfaces of the at least one pattern groove.

* * * * *